United States Patent [19]

Ottoson

[11] 4,378,650

[45] Apr. 5, 1983

[54] SIGNPOST WITH MEANS AND METHOD FOR INSTALLING AND REMOVING THE SAME

[76] Inventor: James A. Ottoson, Rte. 4, Box 159, Monroe, Wis. 53566

[21] Appl. No.: 273,477

[22] Filed: Jun. 15, 1981

[51] Int. Cl.[3] ..... G09F 15/00

[52] U.S. Cl. ..... 40/607

[58] Field of Search ..... 40/606, 607, 584, 10 C, 40/10 R, 617

[56] References Cited

U.S. PATENT DOCUMENTS

| | | | |
|---|---|---|---|
| 2,580,948 | 1/1952 | Pancake | 40/606 |
| 4,249,715 | 2/1981 | Repp | 40/607 |
| 4,258,494 | 3/1981 | Borque | 40/607 |
| 4,326,352 | 4/1982 | Barth | 40/607 |
| 4,327,514 | 4/1982 | Bourque | 40/607 |

*Primary Examiner*—Gene Mancene
*Assistant Examiner*—Wenceslao J. Contreras
*Attorney, Agent, or Firm*—Zarley, McKee, Thomte, Voorhees & Sease

[57] ABSTRACT

A signpost comprises a base adapted for being driven into the ground, a vertical post member fitting over a portion of the base extending above the ground and into a collar on the base, and a horizontal post member from which a sign is attached being connected to the vertical post member. The base is easily removed from the ground by the use of a fulcrum and a lever arm to which a ring is attached. Placing the ring over the upper portion of the base and forcing down on the opposite end of the lever arm pulls the base from the ground.

1 Claim, 7 Drawing Figures

SIGNPOST WITH MEANS AND METHOD FOR INSTALLING AND REMOVING THE SAME

BACKGROUND OF THE INVENTION

This invention relates to a signpost with means and method for installing and removing the same.

The conventional signpost typically requires much physical labor for its installation, such as digging a hole, tamping the post, or extensive pounding of the post. Likewise, the removal of the conventional signpost requires labor such as removal of dirt or pushing and pulling the post until it is loose. This type of installation or removal is more than one would like to do in an ordinary business suit. The conventional signpost is also subject to tipping in loose soil or being turned or bent by vandals or children playing in the area.

Therefore, a primary object of the present invention is the provision of a signpost with means and method for installing and removing the same.

A further object of the present invention is the provision of a signpost which can be easily installed and removed with minimum physical effort.

A further object of the present invention is the provision of a signpost that will not tip in loose soil.

A further object of the present invention is the provision of a signpost which will not spin and will maintain its relative viewing position.

A further object of the present invention is the provision of a signpost with means and method for installing and removing the same which is economical to manufacture and durable in use.

SUMMARY OF THE INVENTION

The present invention comprises the signpost with a base portion pointed at one end for easy installation. Fins attached to the base portion prevent the signpost from tipping in loose soil. The vertical signpost member telescopes from the base portion. A collar fixed to the base portion prevents the vertical post member from spinning out of a viewing perspective. A horizontal member, to which a sign may be attached, is attached to the upper end of the vertical post member.

The base portion of the signpost is driven into the ground with the use of a driving pipe. A butting plate fixed to the driving pipe strikes a corresponding portion of the sign base.

The base of the signpost is easily removed from the ground with the use of a fulcrum and lever arm. A ring attached to one end of the lever arm is placed over the upper portion of the base. As the opposite end of the lever arm is forced downward, the ring frictionally engages the upper portion of the base and pulls the entire base upward from the ground.

DETAILED DESCRIPTION OF THE INVENTION

Figure 1:
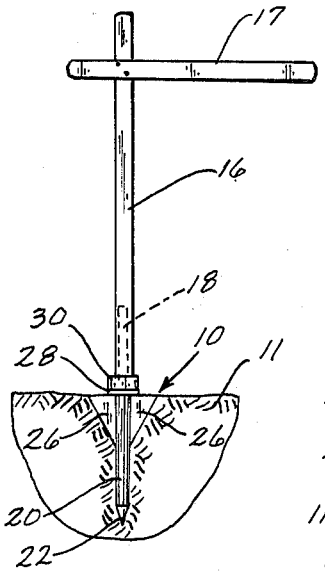
FIG. 1 is a side elevation view of the signpost installed in the ground.

Referring to the drawings, the numeral 10 generally designates the base of the signpost, numeral 11 denotes the ground, numeral 12 indicates the driving apparatus and numeral 14 generally specifies the removal apparatus.

Figure 4:
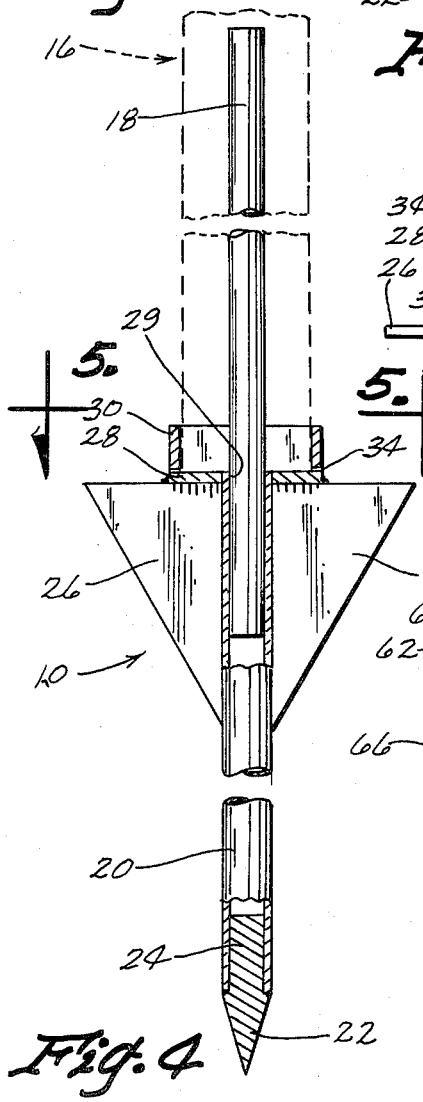
FIG. 4 is a fragmentary side elevational view of the base portion of the signpost.
Figure 5:
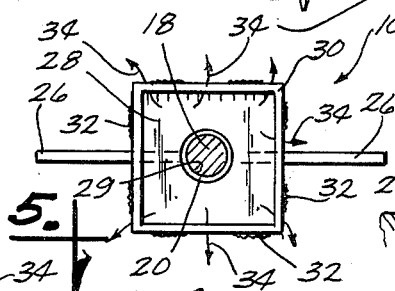
FIG. 5 is a cross-sectional view taken along line 5-5 of FIG. 4.

Referring to FIG. 4, the base end of the signpost has a pipe 20 into which a solid rod 24 with a point 22 is inserted and welded. A solid rod 18 is partially inserted and welded to the opposite end of pipe 20. Solid rod 18 extends above the ground to give internal support to vertical post member 16 to which is connected a horizontal member 17 from which a sign is attached. Welded to pipe 20 are fins 26 which prevent the signpost from tipping or turning in loose soil and which give support to plate 28, with hole 29, which is welded to the top of pipe 20. A square collar 30 is welded by welds 32 in FIG. 5 to plate 28. The gaps in the welds provide for draining of rainwater as indicated by arrows 34.

Figure 2:
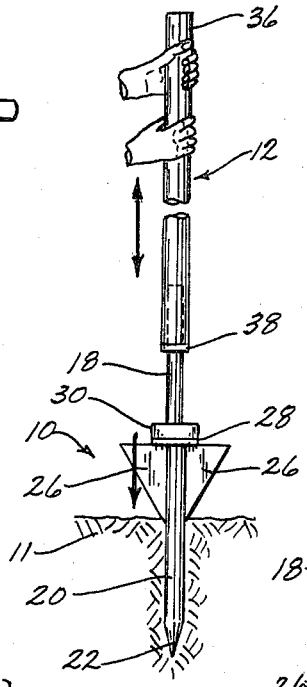
FIG. 2 is a side elevation view of the installing method of the signpost.

To install base 10 of the signpost into ground 11 a driving apparatus 12 is used. Driving apparatus 12 comprises a driving pipe 36 welded to a butting plate 38 with a hole 40 corresponding to the outside diameter of rod 18. Pipe 26 and butting plate 38 slide over rod 18 and contact the top of pipe 20 rather than plate 28. By repeatedly lifting the driving pipe and forcing it down so that the butting plate strikes pipe 20, base 10 is driven into the ground, as indicated in FIG. 2.

Figure 3:
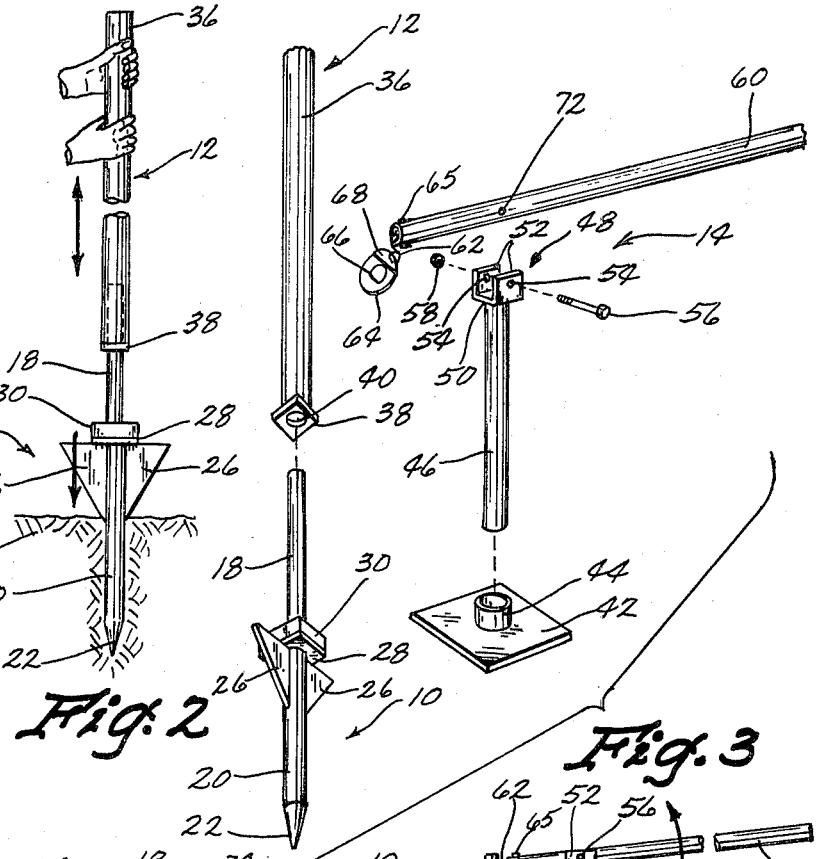
FIG. 3 is an exploded perspective view of the driving device, the base portion of the signpost, and the removal apparatus.
Figure 7:
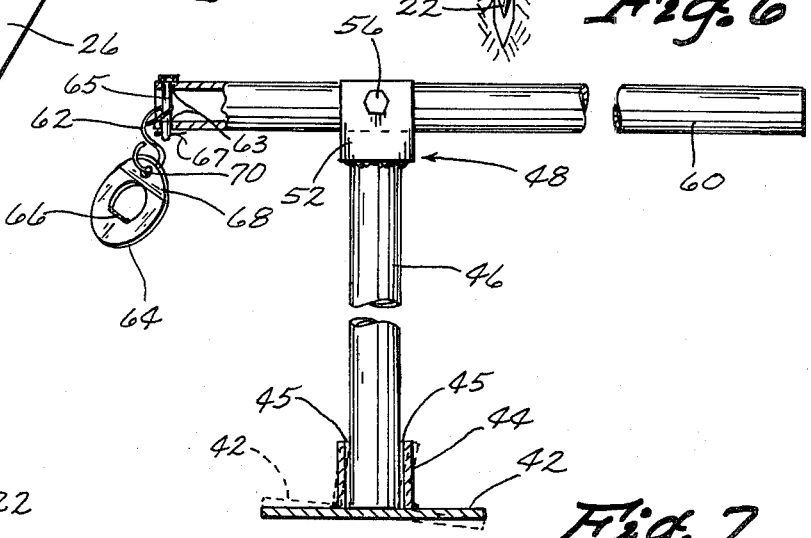
FIG. 7 is a sectional view of the removal apparatus.

Referring to FIGS. 3 and 7, the removal apparatus basically comprises a fulcrum 46, a lever arm 60, and a frictional ring 64. Fulcrum 46 slips into a sleeve 44 welded to a base plate 42 for ground support. A slight gap 45 between sleeve 44 and fulcrum 46 permits the device to be used on unlevel ground. Welded to the top of the fulcrum 46 is a U-shaped channel 48 with horizontal portion 50, vertical guides 52, and holes 54. Lever arm 60 has hole 72 which corresponds to holes 54, through which a bolt 56 passes to engage a nut 58.

At one end of the lever arm 60 are vertically aligned holes 63 through which pin 65 passes. Cotter pin 67 prevents pin 65 from being lost. S-hook 62 is hooked around pin 65. The S-hook also passes through hole 70 in friction ring 64 to connect the friction ring to the lever arm. The friction ring has a flat surface 66 on its inner edge opposite a slight bend 68 in the ring to aid in the frictional engagement of rod 18.

Figure 6:
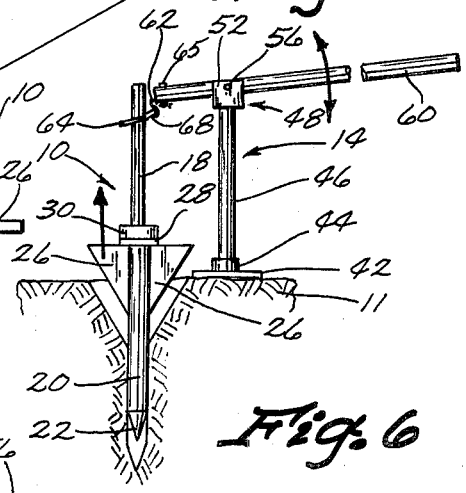
FIG. 6 is a side elevational view showing the use of the removal apparatus.

Referring to FIG. 6, ring 64 is placed over rod 18. As the opposite end of lever arm 60 is forced downward, the arm pivots about bolt 56 and ring 64 thus frictionally engages rod 18. As continued downward force is applied to the lever arm, base 10 is pulled upward from the ground, as indicated in FIG. 6.

Thus, it can be seen that the device accomplishes at least all of its stated objectives. Point 22 on base portion 10 allows for easy installation with the use of driving apparatus 12. Removal apparatus 14 allows for easy removal of the base. Fins 26 prevent the signpost from tipping or turning in loose soil and collar 30 prevents the vertical post member 16 from turning beyond the viewing orientation. The device is also durable in use and economical to manufacture.

What is claimed is:

1. A wooden signpost and metal mounting base comprising, a metal mounting base having a first pointed end section for extending into the ground and a second upstanding end section for extending above the ground, said second section being of uniform circular cross section along its length, a wooden signpost having an axial circular opening for matingly receiving said second section of said metal mounting base and the cross-sectional area of said wooden post less the area of said axial opening being sufficient to provide vertical and lateral support on said second section of said metal mounting base, a collar rigidly secured on said metal mounting base at the juncture of said first and second sections for limiting the penetration of said first section into the ground and supporting said wooden signpost therein and said collar and said wooden post having cooperating multisided surfaces for limiting rotation of said wooden post relative to said collar and said mounting base, and metal fins mounted on the first end section below said collar for limiting rotation of said first end section and said mounting base relative to the ground.

* * * * *